US010629395B1

(12) United States Patent
Fu et al.

(10) Patent No.: US 10,629,395 B1
(45) Date of Patent: Apr. 21, 2020

(54) KEYBOARD MEMBRANE CIRCUIT BOARD WITH LIQUID DRAINAGE PATH

(71) Applicant: Chicony Electronics Co., Ltd., New Taipei (TW)

(72) Inventors: Chia-Hung Fu, New Taipei (TW); Chun-Wei Chien, New Taipei (TW)

(73) Assignee: Chicony Electronics Co., Ltd., New Taipei (TW)

( * ) Notice: Subject to any disclaimer, the term of this patent is extended or adjusted under 35 U.S.C. 154(b) by 0 days.

(21) Appl. No.: 16/372,806

(22) Filed: Apr. 2, 2019

(30) Foreign Application Priority Data

Dec. 13, 2018 (TW) ..... 107145096 A

(51) Int. Cl.
*H01H 13/705* (2006.01)
*H01H 13/82* (2006.01)
*H01H 13/86* (2006.01)

(52) U.S. Cl.
CPC ..... *H01H 13/86* (2013.01); *H01H 13/705* (2013.01); *H01H 13/82* (2013.01)

(58) Field of Classification Search
CPC ..... H01H 2223/004; H01H 13/82; H01H 2213/008; H01H 2227/02; G06F 3/0219
See application file for complete search history.

(56) References Cited

U.S. PATENT DOCUMENTS 4,400,595 A * 8/1983 Ahumada ..... H01H 13/702 200/306
6,803,865 B2 * 10/2004 DeLuga ..... G06F 1/1616 341/22
7,030,330 B2 * 4/2006 Suda ..... G06F 3/0202 200/302.2
7,365,281 B2 * 4/2008 Yamaguchi ..... G06F 3/0202 200/302.1
2008/0266782 A1 * 10/2008 Zhang ..... G06F 3/0202 361/679.08

FOREIGN PATENT DOCUMENTS

TW M455199 U 6/2013
TW M502941 U 6/2013

* cited by examiner

*Primary Examiner* — Vanessa Girardi
(74) *Attorney, Agent, or Firm* — Muncy, Geissler, Olds & Lowe, P.C.

(57) ABSTRACT

A keyboard device includes a substrate, keycaps, and a membrane circuit board. The substrate has an upper surface including assembly areas, and the upper surface has an assembly member. The keycaps are disposed on the substrate and respectively corresponding to the assembly areas. The membrane circuit board is disposed between the substrate and the keycaps. The membrane circuit board includes an upper membrane layer having an upper layer hole, a lower membrane layer having a lower layer hole, and a spacing layer having a middle layer hole. The upper layer hole, the middle layer hole, and the lower layer hole communicate with each other. The assembly member protrudes upwardly from the lower layer hole, the middle layer hole, and the upper layer hole. The upper membrane layer includes a water-baffling edge between edges of the upper layer hole and the middle layer hole.

16 Claims, 12 Drawing Sheets

KEYBOARD MEMBRANE CIRCUIT BOARD WITH LIQUID DRAINAGE PATH

CROSS-REFERENCE TO RELATED APPLICATION

This non-provisional application claims priority under 35 U.S.C. § 119(a) to Patent Application No. 107145096 filed in Taiwan, R.O.C. on Dec. 13, 2018, the entire contents of which are hereby incorporated by reference.

BACKGROUND

Technical Field

The instant disclosure relates to an input device, in particular, to a keyboard device.

Related Art

Keyboards are common input devices. Usually, they are used along with electronic devices, such as desktop computers, notebook computers, smart phones, tablets, etc. Along with the "thin and light" trend for electronic devices, most keyboards use small, thin, and light membrane circuit boards.

In general, the membrane circuit board is disposed between a plurality of keys and the base plate. The membrane circuit board mainly includes three membranes glued with each other. Opposite surfaces of the upper membrane layer and the lower membrane layer are printed with conductive patterns and conductive contacts, and positions of the conductive contacts corresponds to positions of the keys. The middle layer prevents the direct contact between the conductive patterns of the upper membrane layer and the conductive patterns of the lower membrane layer.

Furthermore, in order to allow the keys to be assembled with assembly structures on the base plate, the membrane circuit board has several through holes, so that the assembly structures can protrude from the through holes to be assembled with the keys. However, during the use of a keyboard device known to the inventor(s), if water (or liquid) flow into the through holes, the water (or liquid) may further flow into the interior of the membrane circuit board from the gaps between the three layers, thereby resulting in the unbonding between the layers of the membrane circuit board or the short-circuit situation due to contacts between the water (or liquid) and the conductive patterns.

SUMMARY

In view of this, in one embodiment, a keyboard device is provided and the keyboard device comprises a substrate, a plurality of keycaps, and a membrane circuit board. The substrate has an upper surface comprising a plurality of assembly areas, and the upper surface has at least one assembly member disposed thereon. The keycaps are disposed on the substrate and respectively corresponding to the assembly areas. The membrane circuit board is disposed between the substrate and the keycaps. The membrane circuit board comprises an upper membrane layer, a lower membrane layer, and a spacing layer between the upper membrane layer and the lower membrane layer. The upper membrane layer comprises an upper layer hole, the spacing layer comprises a middle layer hole, and the lower membrane layer comprises a lower layer hole. The upper layer hole, the middle layer hole, and the lower layer hole communicate with each other. The at least one assembly member protrudes upwardly from the lower layer hole, the middle layer hole, and the upper layer hole. The upper membrane layer comprises a water-baffling edge formed between an edge of the upper layer hole and an edge of the middle layer hole.

In another embodiment, a keyboard device is provided and the keyboard device comprises a substrate, a plurality of keycaps, a membrane circuit board, and a water-baffling layer. The substrate has an upper surface comprising a plurality of assembly areas, and the upper surface has at least one assembly member disposed thereon. The keycaps are disposed on the substrate and respectively corresponding to the assembly areas. The membrane circuit board is disposed between the substrate and the keycaps. The membrane circuit board comprises an upper membrane layer, a lower membrane layer, and a spacing layer between the upper membrane layer and the lower membrane layer. The upper membrane layer has an upper layer hole, the spacing layer has a middle layer hole, and the lower membrane layer has a lower layer hole. The upper layer hole, the middle layer hole, and the lower layer hole communicate with each other. The water-baffling layer is stacked on the upper membrane layer of the membrane circuit board. The water-baffling layer comprises a through hole corresponding to the upper layer hole, the middle layer hole, and the lower layer hole. The at least one assembly member protrudes upwardly from the lower layer hole, the middle layer hole, the upper layer hole, and the through hole. The water-baffling layer comprises a water-baffling edge located between an edge of the through hole and an edge of the upper layer hole.

As above, according to the keyboard device of one or some embodiments of the instant disclosure, the upper membrane layer of the membrane circuit board has the water-baffling edge located between the edge of the upper layer hole and the edge of the middle layer hole. Therefore, during the operation of the keyboard device, when water (or liquid) unintentionally enters into the keyboard device, the water-baffling edge blocks the water (or liquid) from flowing to the edge of the middle layer hole and the edge of the lower layer hole, so that the water (or liquid) does not enter into the membrane circuit board from the gap(s) between the upper membrane layer and the spacing layer as well as the gap(s) between the spacing layer and the lower membrane layer. Therefore, the waterproof function of the membrane circuit board can be enhanced to prevent unbonding between the layers of the membrane circuit board and to avoid the short-circuit situation.

BRIEF DESCRIPTION OF THE DRAWINGS

The disclosure will become more fully understood from the detailed description given herein below for illustration only, and thus not limitative of the disclosure, wherein.

DETAILED DESCRIPTION

As shown in FIGS. 1 to 4, a keyboard device according to a first embodiment of the instant disclosure is illustrated. In this embodiment, the keyboard device 1 comprises a substrate 10, a plurality of keycaps 20, and a membrane circuit board 30. The keyboard device 1 may be applied to different electronic devices, e.g., desktop computers, notebook computers, or other electronic devices, so that the user can press the keyboard device 1 to allow corresponding signal(s) to be generated.

Figure 1:
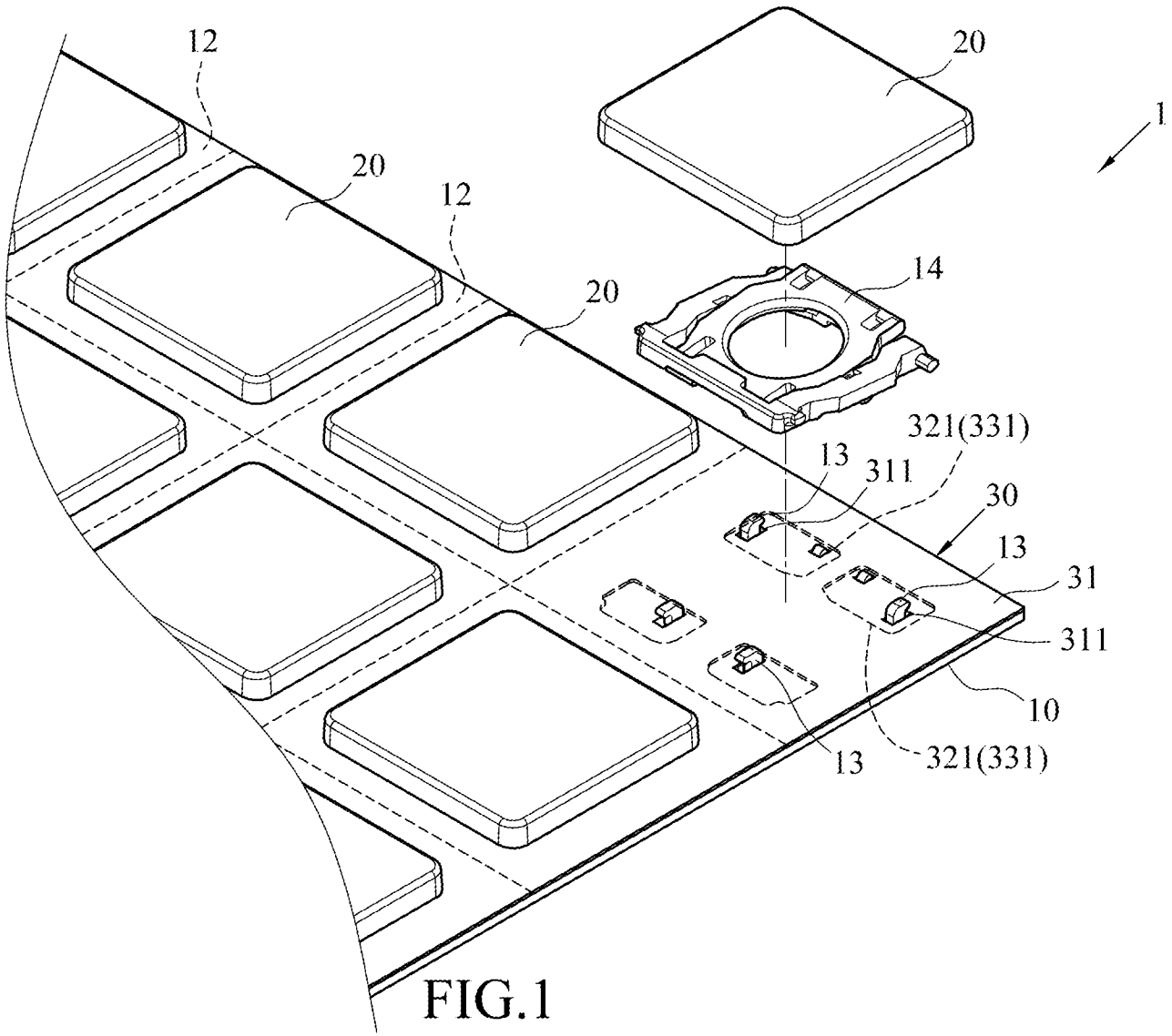
FIG. 1 illustrates a partial perspective view of a keyboard device according to a first embodiment of the instant disclosure.
Figure 2:
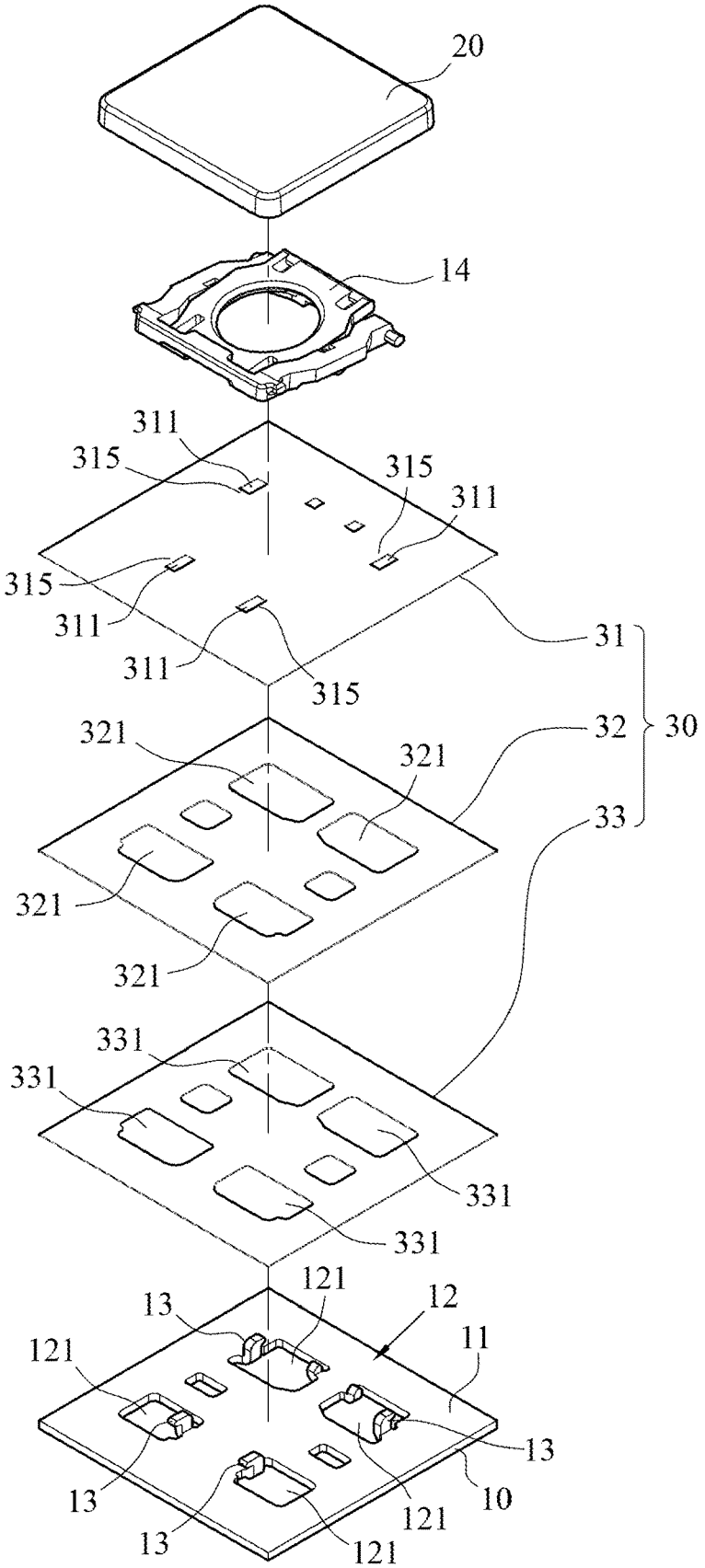
FIG. 2 illustrates a partial exploded view of the keyboard device of the first embodiment.

As shown in FIGS. 1 and 2, the substrate 10 may be a rigid plate made of metal material(s) (e.g., iron, aluminum, or alloy) or plastic material(s). The substrate 10 has an upper surface 11, and the upper surface 11 has a plurality of assembly areas 12. The assembly area 12 is an area of the substrate 10 for assembling with the keycaps 20 (for example, in FIG. 1, the assembly areas 12 are indicated by frames with dashed line). The keycaps 20 are respectively assembled on the assembly areas 12.

Figure 3:
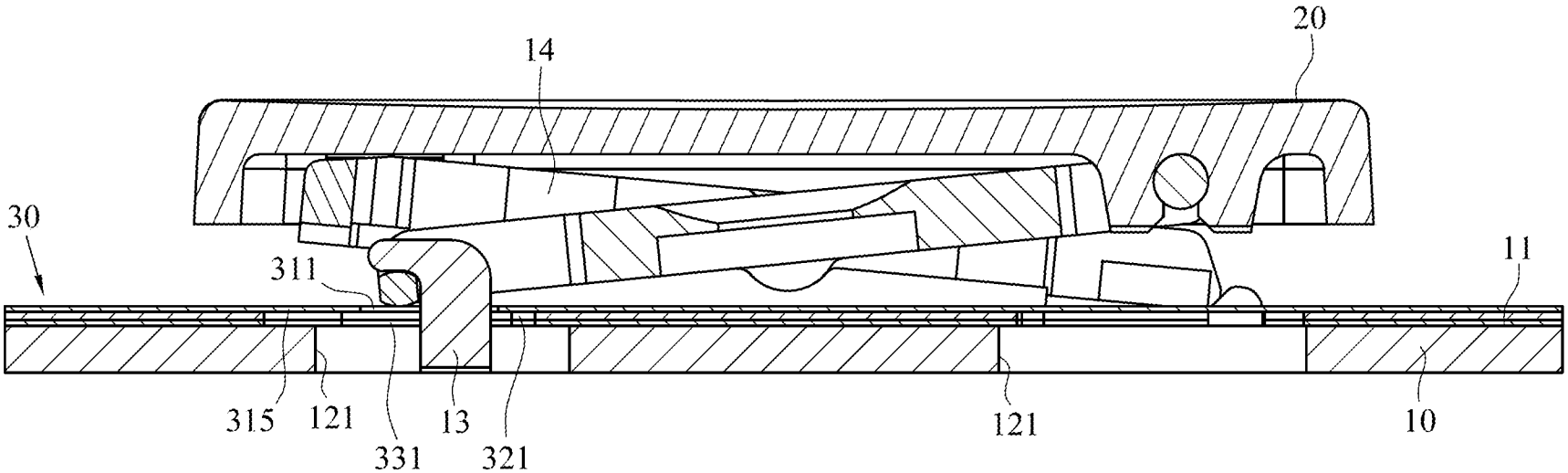
FIG. 3 illustrates a sectional view of the keyboard device of the first embodiment.

As shown in FIGS. 2 and 3, the membrane circuit board 30 is disposed between the substrate 10 and the keycaps 20. The membrane circuit board 30 comprises an upper membrane layer 31, a spacing layer 32, and a lower membrane layer 33 stacked with each other. In some embodiments, the upper membrane layer 31, the spacing layer 32, and the lower membrane layer 33 may be membranes made of polyimide (PI), polyethylene terephthalate (PET), polycarbonate (PC), or other materials. Specifically, in an exemplary embodiment, the lower membrane layer 33 is the bottommost layer and stacked on the upper surface 11 of the substrate 10, the upper membrane layer 31 is the topmost layer, and the spacing layer 32 is sandwiched between the upper membrane layer 31 and the lower membrane layer 33. In some embodiments, the upper membrane layer 31, the spacing layer 32, and the lower membrane layer 33 may be adhered with each other by glues, but embodiments of the instant disclosure are not limited thereto.

In some embodiments, the bottom surface of the upper membrane layer 31 and the top surface of the lower membrane layer 33 may comprise a plurality of conductive patterns and a plurality of conductive contacts. The conductive patterns may be, for example, copper patterns, silver paste patterns, or other patterns made of conductive materials. The conductive contacts correspond to the keycaps 20, and the conductive contacts may be, for example, copper foils, silver foils, or other foils made of conductive materials. The spacing layer 32 comprises vias corresponding to the conductive contacts. When the keycap 20 is pressed, the corresponding conductive contacts of the upper membrane layer 31 and the corresponding conductive contacts of the lower membrane layer 33 can be in conduction with each other through the vias to trigger corresponding signal(s), figures for illustrating such operation is omitted.

As shown in FIGS. 2 and 3, each of the assembly areas 12 of the substrate 10 has a plurality of assembly members 13 disposed thereon. As shown in FIG. 2, in this embodiment, each of the assembly areas 12 comprises several assembly members 13. In this embodiment, each of the assembly members 13 may be formed by punching techniques, so that a crack hole 121 is formed adjacent to each of the assembly members 13. For example, each of the assembly members 13 may be a hook member extending upwardly and bent from the edge of the corresponding crack hole 121, but embodiments of the instant disclosure are not limited thereto. Each layer of the membrane circuit board 30 has holes corresponding to each of the assembly members 13. As shown in FIGS. 2 and 3, the upper membrane layer 31 of the membrane circuit board 30 comprises a plurality of upper layer holes 311, the spacing layer 32 of the membrane circuit board 30 comprises a plurality of middle layer holes 321, and the lower membrane layer 33 of the membrane circuit board 30 comprises a plurality of lower layer holes 331. Each of the upper layer holes 311, each of the middle layer holes 321, and each of the lower layer holes 331 communicate with each other and correspond to each of the assembly members 13, respectively. Therefore, each of the assembly members 13 protrudes upwardly from each of the lower layer holes 331, each of the middle layer holes 321, and each of the upper layer holes 311 and extending out of the surface of the membrane circuit board 30 for assembly.

As shown in FIGS. 2 and 3, a connecting member 14 may be provided between the keycap 20 and the substrate 10. In this embodiment, the connecting member 14 is a scissor component, but embodiments of the instant disclosure are not limited thereto. The bottom portion of the connecting member 14 may be pivoted with the assembly member 13, and the top portion of the connecting member 14 may be pivoted with the bottom portion of the keycap 20. Therefore, when the keycap 20 is pressed, the keycap 20 can have raising or lowering movements relative to the substrate 10 by the guiding of the connecting member 14; however, the foregoing embodiments are provided as illustrative purposes. In some other embodiments, the crack hole 121 on each of the assembly areas 12 of the substrate 10 may be an accommodating hole for receiving component(s) below the keycap 20, so that the component(s) below the keycap 20 does not interfere or impact the substrate 10 during the keycap 20 performs the raising or lowering movements. In this embodiment, each of the assembly members 13 protrudes upwardly from each of the lower layer holes 331, each of the middle layer holes 321, and each of the upper layer holes 311 and extending out of the surface of the membrane circuit board 30 for assembling with the connecting member 14, but embodiments of the instant disclosure are not limited thereto; in some embodiments, each of the assembly members 13 may be adapted to be assembled with other mechanisms.

Figure 4:
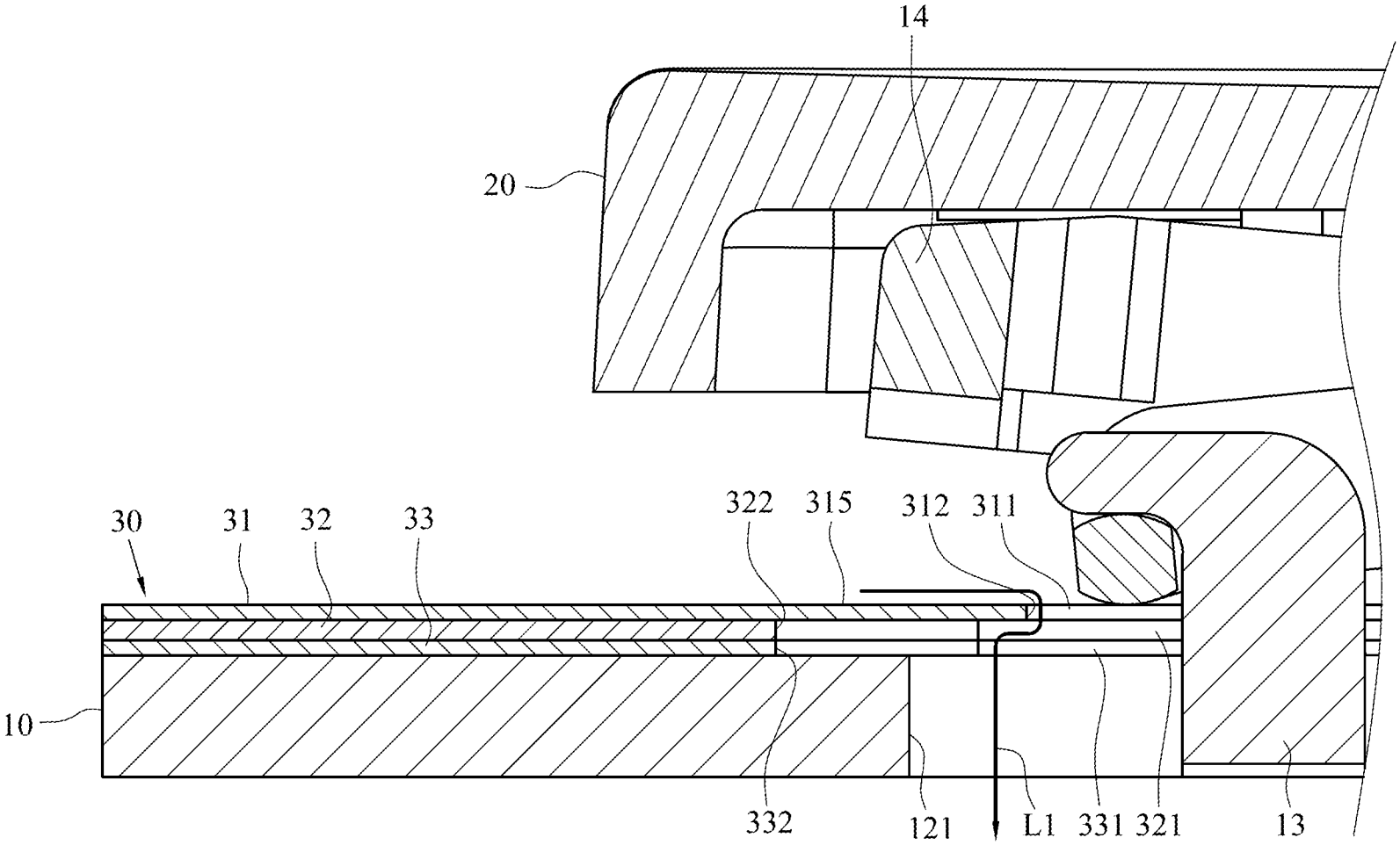
FIG. 4 illustrates an enlarged partial sectional view of the keyboard device of the first embodiment.

As shown in FIGS. 2 to 4, the upper membrane layer 31 of the membrane circuit board 30 further comprises a plurality of water-baffling edges 315. Each of the water-baffling edges 315 is formed between an edge 312 of each of the upper layer holes 311 and an edge 322 of each of the middle layer holes 321. For example, as shown in FIGS. 1 and 4, taking the top surface of the upper membrane layer 31 as the orthographic projection surface, the orthographic projection of the edge 312 of the upper layer hole 311 is located within the orthographic projection of the edge 322 of the middle layer hole 321 and the orthographic projection of an edge 332 of the lower layer hole 331. In this embodiment, the edge 322 of the middle layer hole 321 and the edge 332 of the lower layer hole 331 are flush with each other, but embodiments of the instant disclosure are not limited thereto. Furthermore, since the orthographic projection of the edge 312 of the upper layer hole 311 is located within the orthographic projection of the edge 322 of the middle layer hole 321 and the orthographic projection of the edge 332 of the lower layer hole 331, the upper membrane layer 31 forms the water-blocking edge 315 in annular shaped to shield the edge 322 of the middle layer hole 321 and the edge 332 of the lower layer hole 331 to provide a waterproof function. Related descriptions are provided as below with figures.

Figure 5:
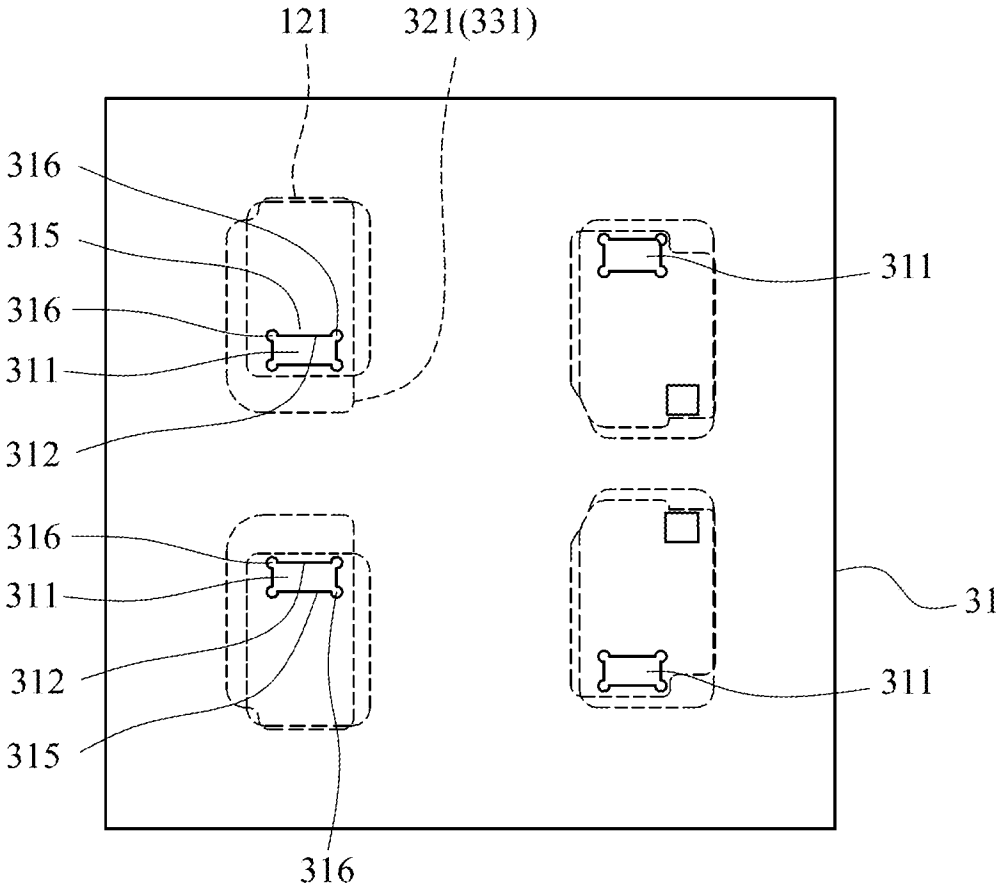
FIG. 5 illustrates a partial top view of a keyboard device according to a second embodiment of the instant disclosure.

As shown in FIG. 4, during the operation of the keyboard device 1, when the water (or liquid) unintentionally enters into the keyboard device 1 (as indicated by the arrow L1), the water-baffling edge 315 blocks most of the water (or liquid) on the upper membrane layer 31. Even if a portion of the water (or liquid) flows into the upper layer hole 311, since the water-baffling edge 315 shields the edge 322 of the middle layer hole 321 and the edge 332 of the lower layer hole 331, the water (or liquid) drops directly and does not flow to the edge 322 of the middle layer hole 321 and the edge 332 of the lower layer hole 331. Hence, water (or liquid) does not enter into the membrane circuit board 30 from the gap(s) between the upper membrane layer 31 and the spacing layer 32 as well as the gap(s) between the spacing layer 32 and the lower membrane layer 33. Therefore, the waterproof function of the membrane circuit board 30 can be enhanced to prevent unbonding between the layers of the membrane circuit board 30 and to avoid the short-circuit situation. Furthermore, as shown in FIG. 4, in one embodiment, taking the top surface of the upper membrane layer 31 as the orthographic projection surface, the orthographic projection of the upper layer hole 312, the orthographic projection of the middle layer hole 322, and the orthographic projection of the lower layer hole 332 are at least partially overlapped with the orthographic projection of the crack hole 121 of the substrate 10 (as shown in FIG. 5), so that the upper layer hole 312, the middle layer hole 322, the lower layer hole 332, and the crack hole 12 have communicating portions therebetween. Accordingly, when water (or liquid) drops into the upper layer hole 312, the water (or liquid) can flow out of the keyboard device 1 from the crack hole 121 of the substrate 10, thereby the waterproof function of the keyboard device 1 being further improved.

Furthermore, as shown in FIGS. 1 and 4, in one embodiment, the edge 312 of each of the upper layer holes 311 of the upper membrane layer 31 may be adjacent to each of the assembly members 13 to further improve the waterproof function of the membrane circuit board 30. For example, in this embodiment, the size of each of the upper layer holes 312 is slightly greater than the size of each of the assembly members 13, so that the gap between the edge 312 of each of the upper layer holes 311 and each of the assembly members 13 can be greatly reduced. Hence, when water (or liquid) flows to the edge 312 of the upper layer hole 311, the water (or liquid) performs a capillary phenomenon and adheres between the assembly member 13 and the edge 312. Therefore, the possibility and the amount of water (or liquid) flowing into the upper layer hole 311 can be reduced such that the waterproof function of the membrane circuit board 30 can be further improved.

Figure 6:
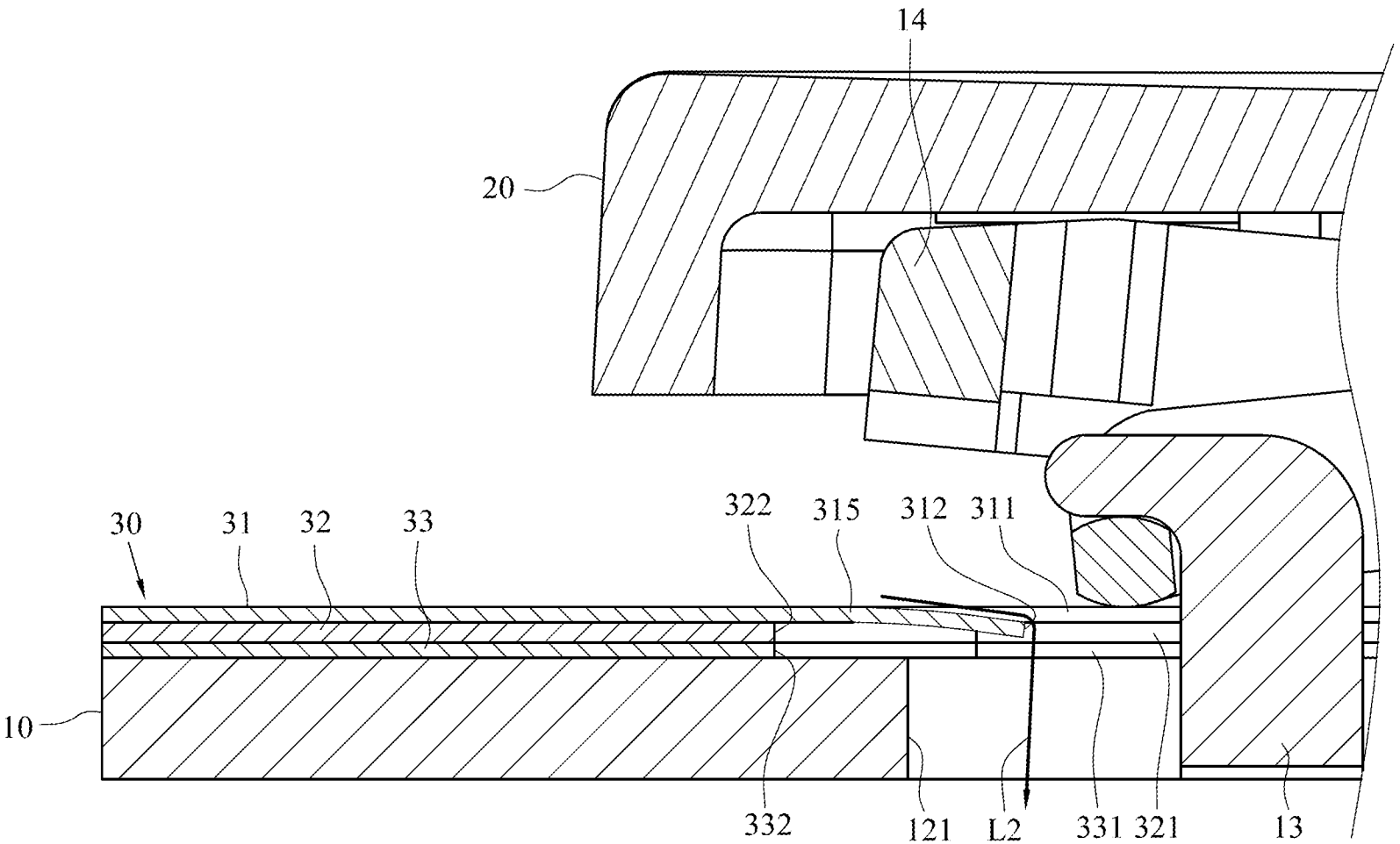
FIG. 6 illustrates an enlarged partial sectional view of the keyboard device of the second embodiment.

Please refer to FIG. 5. FIG. 5 illustrates a partial top view of a keyboard device according to a second embodiment of the instant disclosure. Please refer to the differences between FIGS. 2 and 4 and FIG. 5. The edge 312 of each of the upper layer holes 311 of the upper membrane layer 31 of the membrane circuit board 30 in this embodiment further comprise at least one notch 316. For example, in this embodiment, the edge 312 of each of the upper layer holes 311 comprises four round notches 316. Accordingly, as shown in FIGS. 5 and 6, with the notches 316, the rigidity of the water-baffling edge 315 can be reduced. Therefore, when water (or liquid) flows to the water-baffling edge 315, the water-baffling edge 315 bears the weight of water (or liquid) and sags downwardly (as indicated by the arrow L2 shown in FIG. 6). Hence, water (or liquid) can flow out of the crack hole 121 of the substrate 10 in a faster speed so as to improve the waterproof function.

Figure 7:
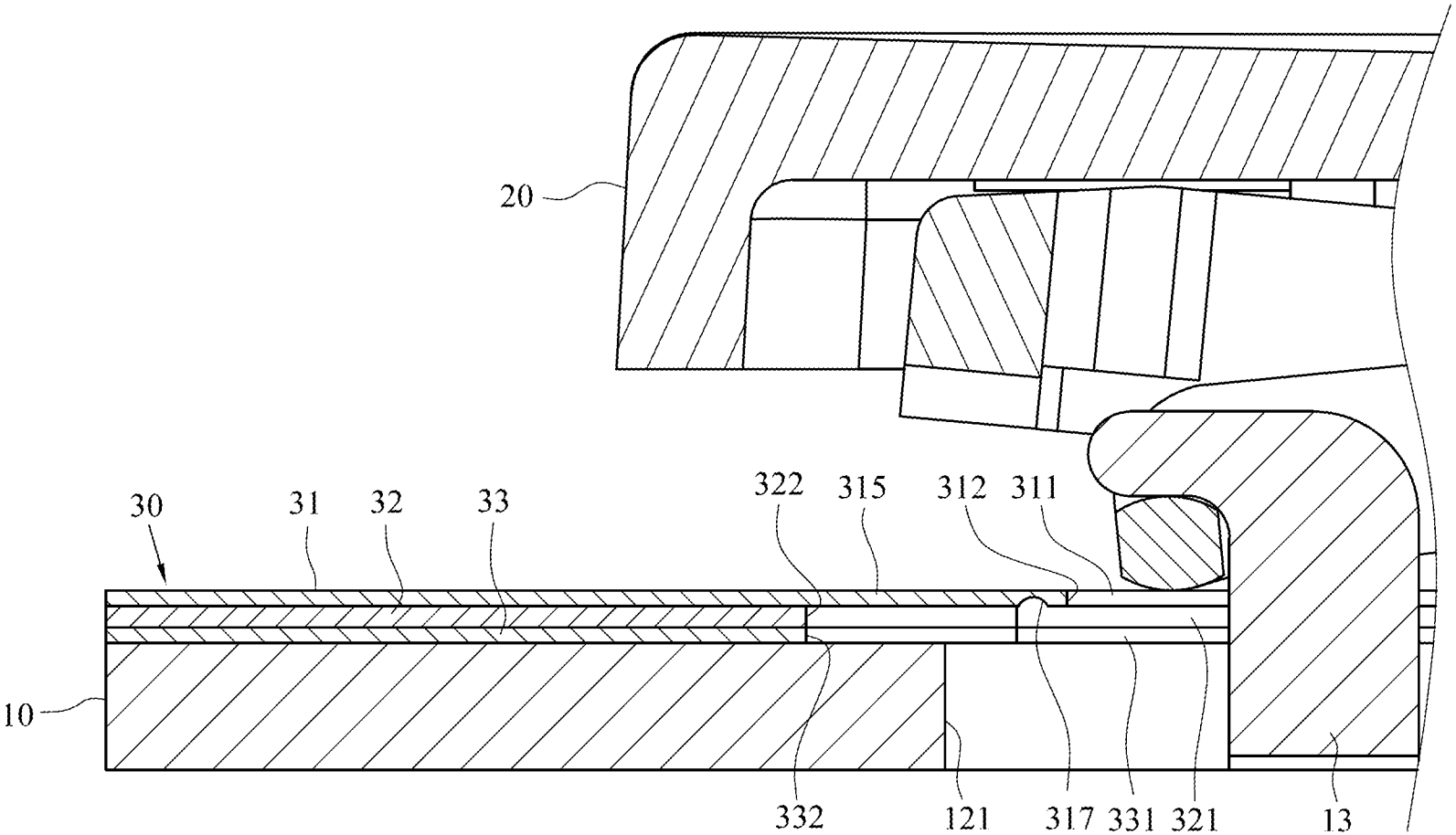
FIG. 7 illustrates an enlarged partial sectional view of a keyboard device according to a third embodiment of the instant disclosure.

Please refer to FIG. 7. FIG. 7 illustrates an enlarged partial view of a keyboard device according to a third embodiment of the instant disclosure. Please refer to the differences between FIG. 4 and FIG. 7. The surface of the water-baffling edge 315 of the membrane circuit board 30 in this embodiment further comprises a water-blocking structure 317 to block water (or liquid) from flowing toward the edge 322 of the middle layer hole 321. For example, in this embodiment, the water-blocking structure 317 is an annular groove on the lower surface of the water-baffling edge 315, but embodiments of the instant disclosure are not limited thereto. In some embodiments, the water-blocking structure 317 may be other structures (e.g., an annular flange). Alternatively, the water-blocking structure 317 may be on the upper surface of the water-baffling edge 315 to reduce the possibility and the amount of water (or liquid) flowing into the upper layer hole 311.

Figure 8:
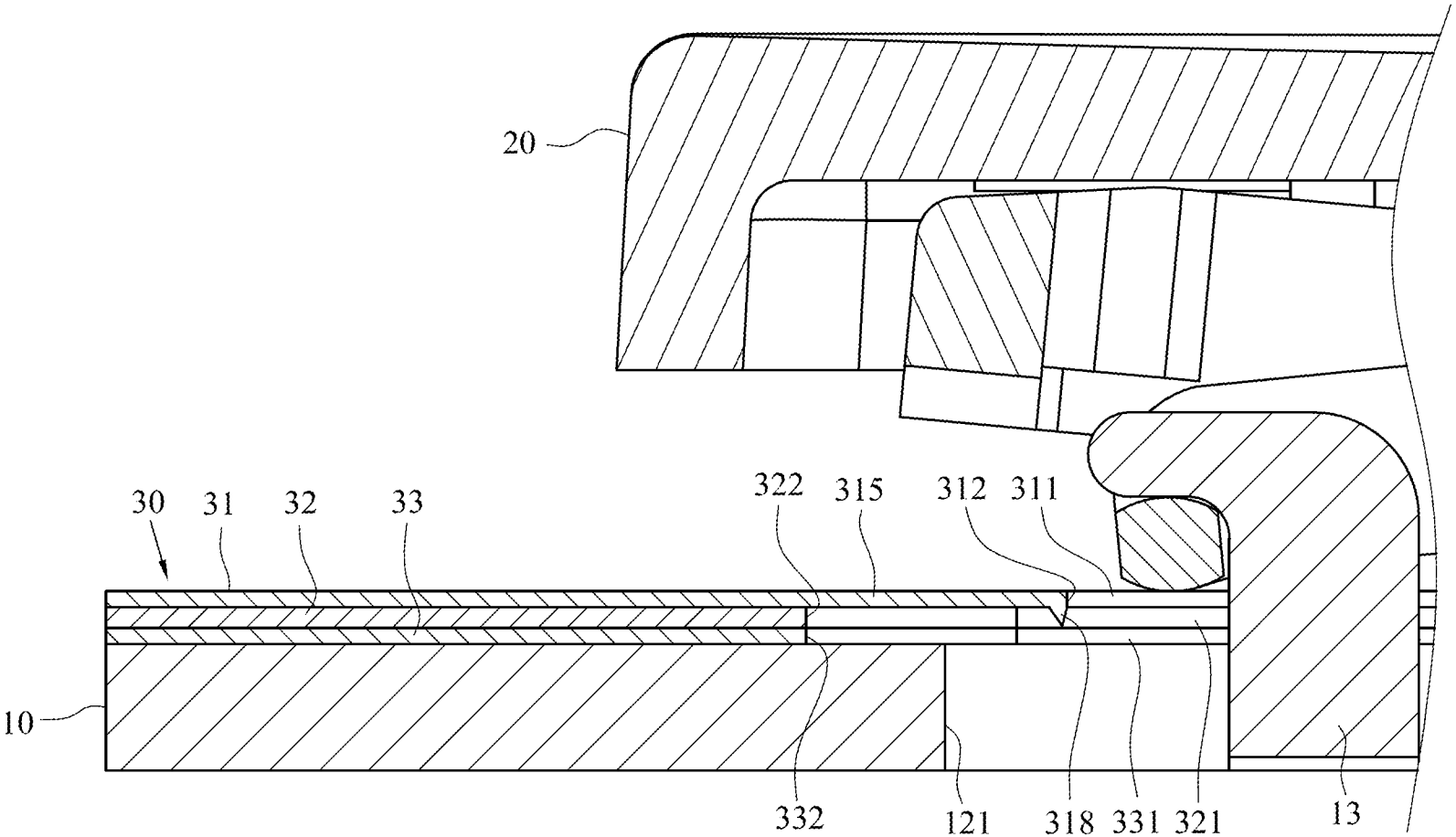
FIG. 8 illustrates an enlarged partial sectional view of a keyboard device according to a fourth embodiment of the instant disclosure.

Please refer to FIG. 8. FIG. 8 illustrates an enlarged partial view of a keyboard device according to a fourth embodiment of the instant disclosure. Please refer to the differences between FIGS. 7 and 8. In this embodiment, the water-blocking structure 318 of the water-baffling edge 315 of the membrane circuit board 30 is a burr structure. For example, during the punching procedure for forming the upper layer hole 312, the punching machine is applied on the upper membrane layer 311 in a top-to-bottom direction to form the upper layer hole 312, so that the burr structure (namely, the water-blocking structure 318 in this embodiment) can be located at the edge portion connecting to the lower surface of the water-baffling edge 315 to block water or liquid from flowing toward the edge 322 of the middle layer hole 321.

Figure 9:
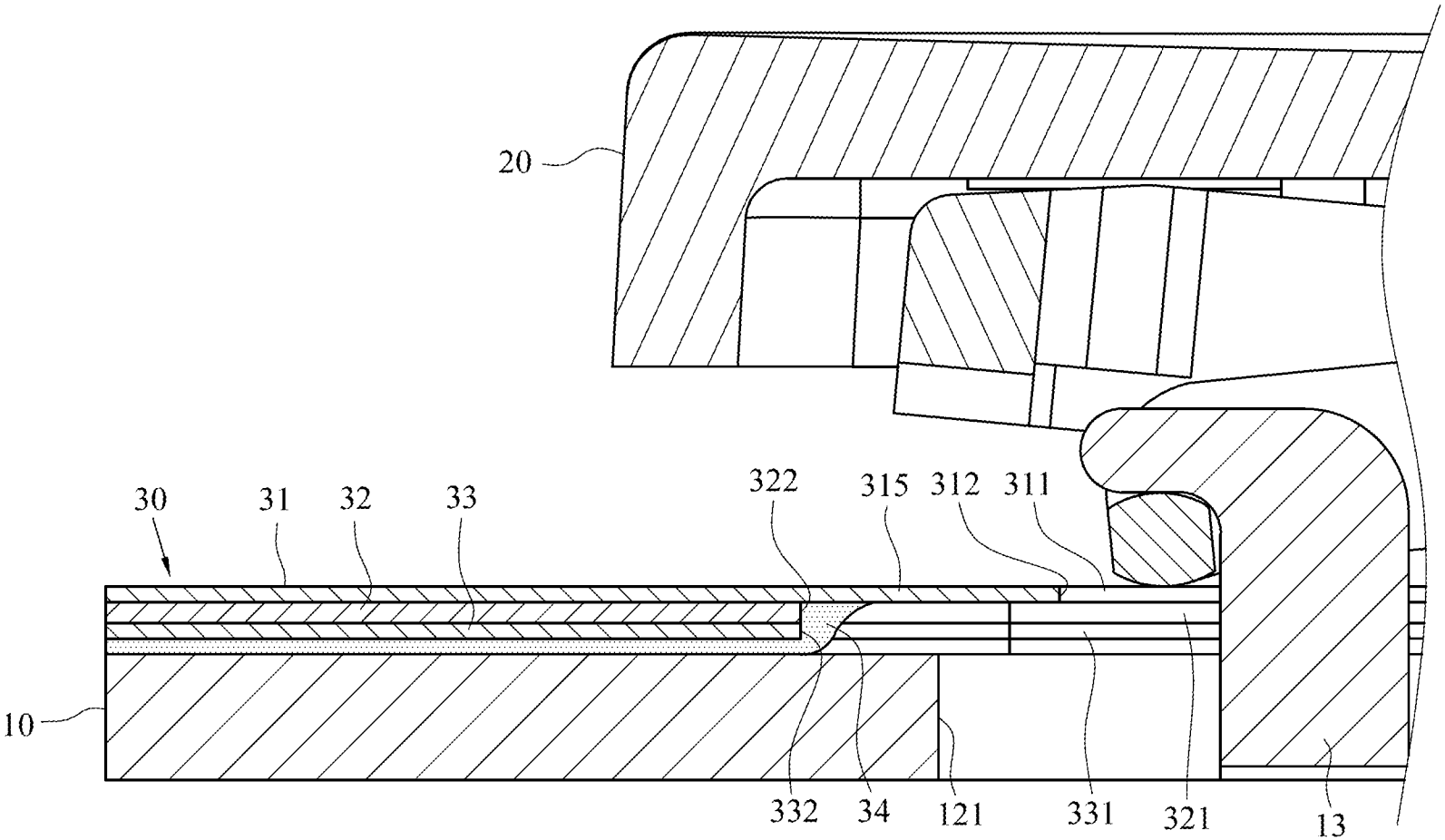
FIG. 9 illustrates an enlarged partial sectional view of a keyboard device according to a fifth embodiment of the instant disclosure.

Please refer to FIG. 9. FIG. 9 illustrates an enlarged partial view of a keyboard device according to a fifth embodiment of the instant disclosure. Please refer to the difference between FIGS. 4 and 9. In this embodiment, the membrane circuit board 30 further comprises a gluing layer 34 covering the edge 322 of the middle layer hole 321 and the edge 332 of the lower layer hole 331. Hence, water or liquid does not enter into the membrane circuit board 30 from the gap(s) between the upper membrane layer 31 and the spacing layer 32 as well as the gap(s) between the spacing layer 32 and the lower membrane layer 33. In this embodiment, the gluing layer 34 is further adhered between the substrate 10 and the lower membrane layer 33 of the membrane circuit board 30 for positioning the membrane circuit board 30 on the substrate 10.

Figure 10:
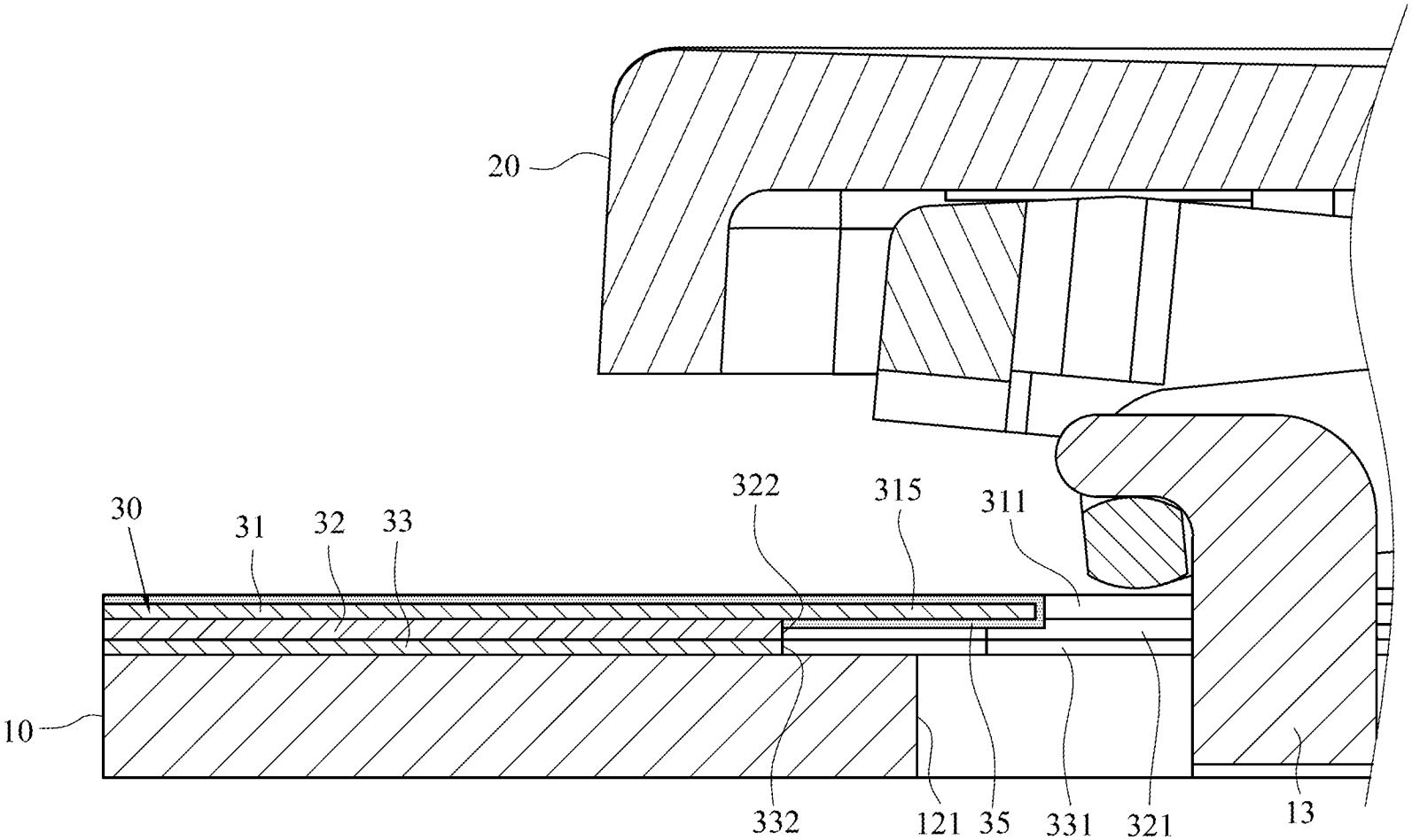
FIG. 10 illustrates an enlarged partial sectional view of a keyboard device according to a sixth embodiment of the instant disclosure.

Please refer to FIG. 10. FIG. 10 illustrates a keyboard device according to a sixth embodiment of the instant disclosure. Please refer to the difference between FIGS. 4 and 10. In this embodiment, the surface of the water-baffling edge 315 further comprises a hydrophobic layer 35. For example, the hydrophobic layer 35 is a layer made of hydrophobic agent(s) coated on the surface of the water-baffling edge 315. Therefore, when water (or liquid) flows to the water-baffling edge 315, the water (or liquid) can be dispersed by the hydrophobic layer 35 to form droplets and not flow into the upper layer hole 311.

Figure 11:
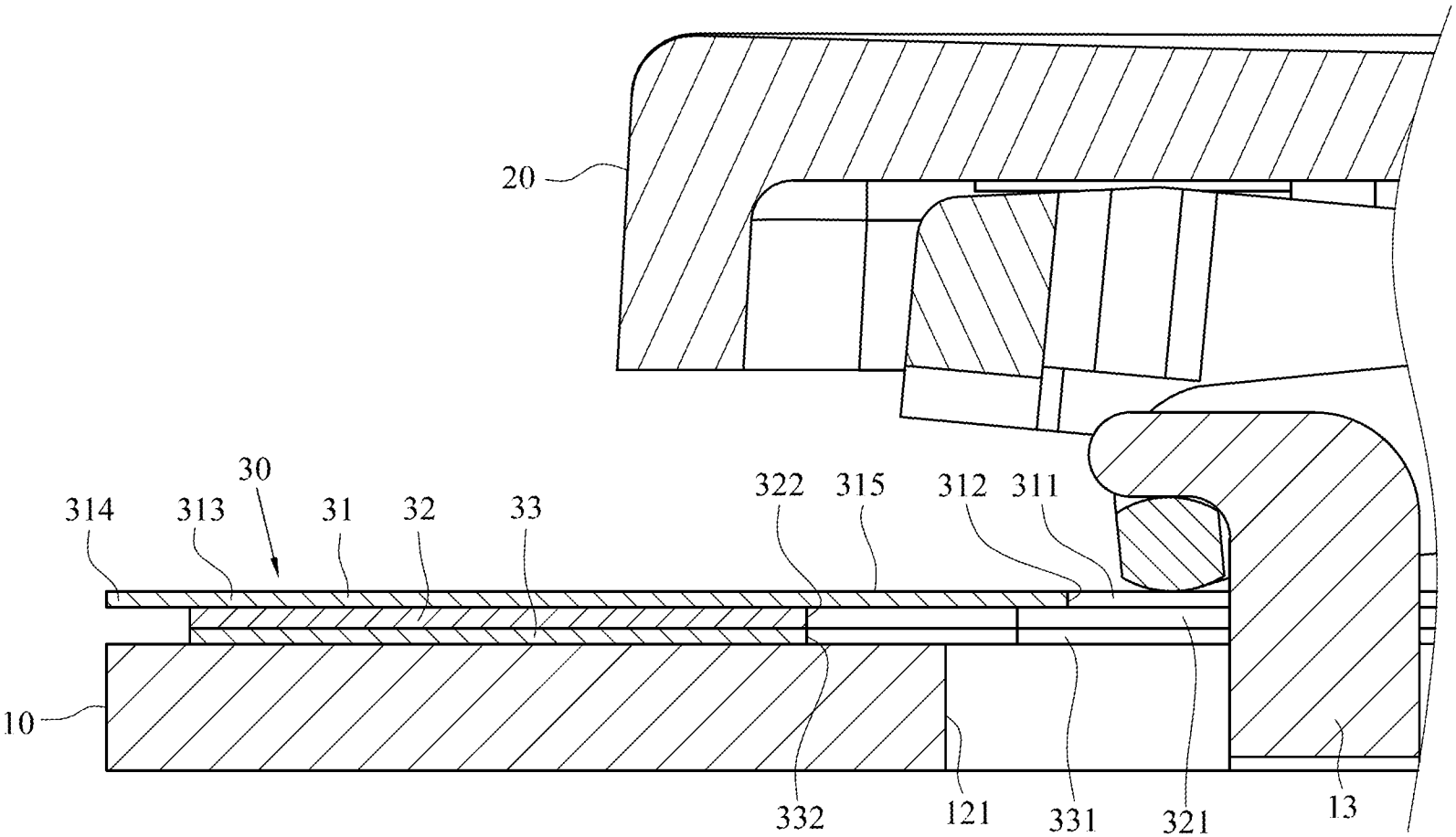
FIG. 11 illustrates an enlarged partial sectional view of a keyboard device according to a seventh embodiment of the instant disclosure.

Please refer to FIG. 11. FIG. 11 illustrates a keyboard device according to a seventh embodiment of the instant disclosure. Please refer to the difference between FIGS. 4 and 11. In this embodiment, the upper membrane layer 31 of the membrane circuit board 30 has an outer periphery portion 313, and an annular baffling edge 314 is integrally extending from the outer periphery portion 313. The annular baffling edge 314 protrudes from an edge of the spacing layer 32 and an edge of the lower membrane layer 33, so that the edge of the spacing layer 32 and the edge of the lower membrane layer 33 can be shielded by the annular baffling edge 314. Therefore, water (or liquid) can be prevented from entering into the membrane circuit board 30 from the gap(s) between the edges of the upper membrane layer 31, the spacing layer 32, and the lower membrane layer 33.

Figure 12:
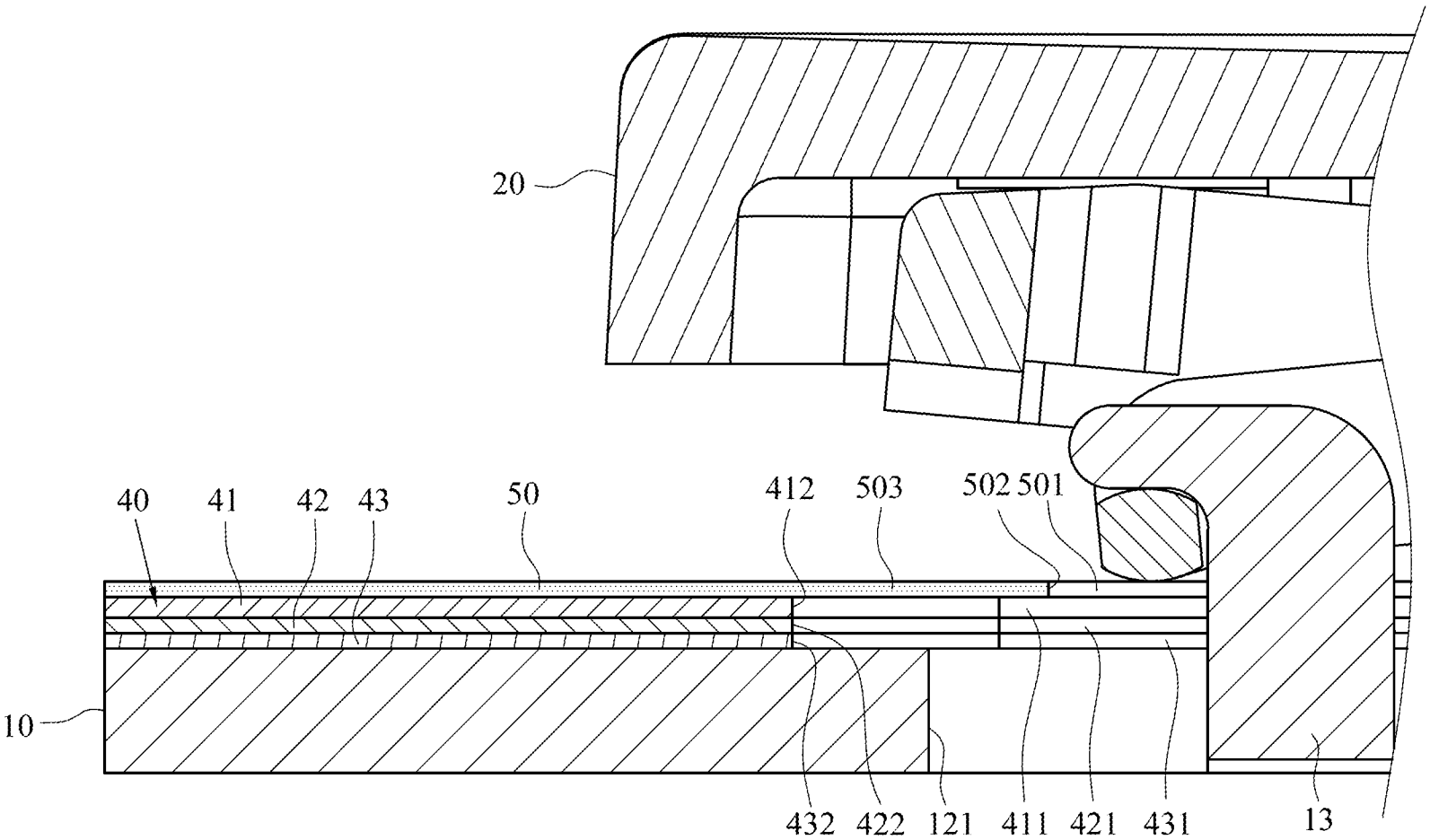
FIG. 12 illustrates an enlarged partial sectional view of a keyboard device according to an eighth embodiment of the instant disclosure.

Please refer to FIG. 12. FIG. 12 illustrates a keyboard device according to an eighth embodiment of the instant disclosure. In this embodiment, the membrane circuit board 40 comprises an upper membrane layer 41, a spacing layer 42, and a lower membrane layer 43. The lower membrane layer 43 is the bottommost layer of the membrane circuit board 40 and stacked on the substrate 10, the upper membrane layer 41 is the topmost layer of the membrane circuit board 40, and the spacing layer 42 is sandwiched between the upper membrane layer 41 and the lower membrane layer 43. The upper membrane layer 41 comprises an upper layer hole 411, the spacing layer 42 comprises a middle layer hole 421, and the lower membrane layer 43 comprises a lower layer hole 431. The upper layer hole 411, the middle layer hole 421, and the lower layer hole 431 communicate with each other and correspond to the crack hole 121. Furthermore, in this embodiment, the sizes of the upper layer hole 411, the middle layer hole 421, and the lower layer hole 431 are the same, so that the edge 412 of the upper layer hole 411, the edge 422 of the middle layer hole 421, and the edge 432 of the lower layer hole 431 are flush with each other, but embodiments of the instant disclosure are not limited thereto.

Further, as shown in FIG. 12, a water-baffling layer 50 is further stacked on the upper membrane layer 41 of the membrane circuit board 40. The water-baffling layer 50 may be a membrane made of polyimide (PI), polyethylene terephthalate (PET), polycarbonate (PC), or other materials, or may be a plate made of plastic(s), but embodiments of the instant disclosure are not limited thereto. The water-baffling layer 50 comprises a through hole 501 corresponding to the upper layer hole 411, the middle layer hole 421, and the lower layer hole 431. The assembly member 13 on the substrate 10 protrudes upwardly from the lower layer hole 431, the middle layer hole 421, the upper layer hole 411, and the through hole 501 and out of the surface of the water-baffling layer 50 for assembling with the keycap 20. The water-baffling layer 50 comprises a water-baffling edge 503, and the water-baffling edge 503 is located between an edge 502 of the through hole 501 and the edge 412 of the upper layer hole 411. For example, taking the top surface of the water-baffling layer 50 as the orthographic projection surface, the orthographic projection of the edge 502 of the through hole 501 is located within the orthographic projection of the edge 412 of the upper layer hole 411, the orthographic projection of the edge 422 of the middle layer hole 421, and the orthographic projection of the edge 432 of the lower layer hole 431, so that the water-baffling layer 50 forms the water-blocking edge 503 in annular shaped to shield the edge 412 of the upper layer hole 411, the edge 422 of the middle layer hole 421, and the edge 432 of the lower layer hole 431. Hence, water (or liquid) does not enter into the membrane circuit board 40 from the gap(s) between the upper membrane layer 41 and the spacing layer 42 as well as the gap(s) between the spacing layer 42 and the lower membrane layer 43 and the waterproof function of the membrane circuit board 40 can be achieved. In some embodiments, the structure of the water-baffling layer 50 may be the same as the upper membrane layer 41 shown in any of the embodiments (from the first embodiment to the seventh embodiment), and repeated descriptions are omitted.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A keyboard device, comprising:

a substrate having an upper surface, wherein the upper surface comprises a plurality of assembly areas, and the upper surface has at least one assembly member disposed thereon;

a plurality of keycaps disposed on the substrate and respectively corresponding to the assembly areas; and a membrane circuit board disposed between the substrate and the keycaps, wherein the membrane circuit board comprises an upper membrane layer, a lower membrane layer, and a spacing layer between the upper membrane layer and the lower membrane layer, wherein the upper membrane layer has an upper layer hole, the spacing layer has a middle layer hole, and the lower membrane layer has a lower layer hole, wherein the upper layer hole, the middle layer hole, and the lower layer hole communicate with each other, wherein the at least one assembly member protrudes upwardly from the lower layer hole, the middle layer hole, and the upper layer hole, wherein the upper membrane layer comprises a water-baffling edge formed between an edge of the upper layer hole and an edge of the middle layer hole.

2. The keyboard device according to claim 1, wherein each of the assembly areas of the substrate comprises a crack hole corresponding to the upper layer hole, the middle layer hole, and the lower layer hole.

3. The keyboard device according to claim 1, wherein the edge of the upper layer hole is adjacent to the at least one assembly member.

4. The keyboard device according to claim 1, wherein the membrane circuit board further comprises a gluing layer covering the edge of the middle layer hole and an edge of the lower layer hole.

5. The keyboard device according to claim 1, wherein a surface of the water-baffling edge further comprises a hydrophobic layer.

6. The keyboard device according to claim 1, wherein the edge of the upper layer hole comprises at least one notch.

7. The keyboard device according to claim 1, wherein a surface of the water-baffling edge further comprises a water-blocking structure.

8. The keyboard device according to claim 1, wherein the upper membrane layer has an outer periphery portion, an annular baffling edge is integrally extending from the outer periphery portion, and the annular baffling edge protrudes from an edge of the spacing layer and an edge of the lower membrane layer.

9. A keyboard device, comprising:

a substrate having an upper surface, wherein the upper surface comprises a plurality of assembly areas, and the upper surface has at least one assembly member disposed thereon;

a plurality of keycaps disposed on the substrate and respectively corresponding to the assembly areas;

a membrane circuit board disposed between the substrate and the keycaps, wherein the membrane circuit board comprises an upper membrane layer, a lower membrane layer, and a spacing layer between the upper membrane layer and the lower membrane layer, wherein the upper membrane layer has an upper layer hole, the spacing layer has a middle layer hole, and the lower membrane layer has a lower layer hole, wherein the upper layer hole, the middle layer hole, and the lower layer hole communicate with each other; and a water-baffling layer stacked on the upper membrane layer of the membrane circuit board, wherein the water-baffling layer comprises a through hole corresponding to the upper layer hole, the middle layer hole, and the lower layer hole, wherein the at least one assembly member protrudes upwardly from the lower layer hole, the middle layer hole, the upper layer hole, and the through hole, wherein the water-baffling layer comprises a water-baffling edge located between an edge of the through hole and an edge of the upper layer hole.

10. The keyboard device according to claim 9, wherein each of the assembly areas of the substrate comprises a crack hole corresponding to the through hole, the upper layer hole, the middle layer hole, and the lower layer hole.

11. The keyboard device according to claim 9, wherein the edge of the through hole is adjacent to the at least one assembly member.

12. The keyboard device according to claim 9, wherein the membrane circuit board further comprises a gluing layer covering the edge of the upper layer hole, an edge of the middle layer hole, and an edge of the lower layer hole.

13. The keyboard device according to claim 9, wherein a surface of the water-baffling edge further comprises a hydrophobic layer.

14. The keyboard device according to claim 9, wherein the edge of the through hole comprises at least one notch.

15. The keyboard device according to claim 9, wherein a surface of the water-baffling edge further comprises a water-blocking structure.

16. The keyboard device according to claim 9, wherein the water-baffling layer has an outer periphery portion, an annular baffling edge is integrally extending from the outer periphery portion, and the annular baffling edge protrudes from an edge of the upper membrane layer, an edge of the spacing layer, and an edge of the lower membrane layer.

* * * * *